United States Patent [19]

Sawai

[11] 4,361,215

[45] Nov. 30, 1982

[54] GUSSETED SUIT CASE

[76] Inventor: Masatake Sawai, 2-16, Siozu-cho, Toyooka City, Hyogo Prefecture, Japan

[21] Appl. No.: 172,150

[22] Filed: Jul. 25, 1980

[51] Int. Cl.[3] ..... A45C 7/00

[52] U.S. Cl. ..... 190/18 A; 190/44

[58] Field of Search ..... 190/18 A, 44

[56] References Cited

U.S. PATENT DOCUMENTS

| | | | |
|---|---|---|---|
| 3,443,671 | 5/1969 | Dyke | 190/44 X |
| 3,879,798 | 4/1975 | Krulwich | 190/18 A X |
| 4,063,581 | 12/1977 | Williams | 190/18 A X |
| 4,126,213 | 11/1978 | McDonald | 190/44 X |

FOREIGN PATENT DOCUMENTS

| | | | |
|---|---|---|---|
| 76415 | 9/1961 | France | 190/44 |

*Primary Examiner*—Donald F. Norton

*Attorney, Agent, or Firm*—McGlew and Tuttle

[57] ABSTRACT

A gusseted suit case with two superimposed gussets defined by vertically spaced webbings sewn to the body of the case. Each of the gussets is provided with a substantially V-shaped opening and a fastener is attached to the opening to erect and collapse the associated gusset. When collapsed, the gusset is completely concealed from the exterior not to impair the appearance of the body of the case.

2 Claims, 5 Drawing Figures

GUSSETED SUIT CASE

BACKGROUND OF THE INVENTION

This invention relates to a gusseted suit case and more particularly, to a gusseted suit case provided with two gussets disposed one upon another and collapsible inwardly when the gussets are not used to thereby give a pleasant appearance to the body of the suit case.

It has been proposed that a suit case be provided, on the bottom thereof, with a single gusset or a bag be provided in a desired position thereof with a single gusset. However, the conventional gusseted suit case or bag is not capable of accommodating articles which vary in size and volume within a wide range. In addition, the appearance of the conventional gusseted suit case or bag is impaired when the gusset is collapsed inwardly. Furthermore, the rigidity of the body of the suit case or bag afforded by the provision of the gusset is not sufficient to prevent the case or bag body from bulging downwardly or laterally or both.

SUMMARY OF THE INVENTION

Therefore, one object of the present invention is to provide a gusseted suit case which can effectively eliminate the disadvantages in the conventional gusseted suit case or bag.

Another object of the present invention is to provide a gusseted suit case provided with two gussets disposed one upon another and collapsible completely when the gussets are not used.

Another object of the present invention is to provide a gusseted suit case provided with two gussets disposed one upon another and collapsible completely when the gussets are not used whereby the suit case can accommodate articles which vary in size and volume within a wide range.

Another object of the present invention is to provide a gusseted suit case provided with two superimposed gussets to provide a bellows construction to a portion of the body of the case.

Another object of the present invention is to provide a gusseted suit case provided with two superimposed gussets defined by vertically spaced webbings and having fasteners which are adapted to erect and collapse the gussets.

Another object of the present invention is to provide a gusseted suit case which has a sufficient rigidity to resist bulging of the case body.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
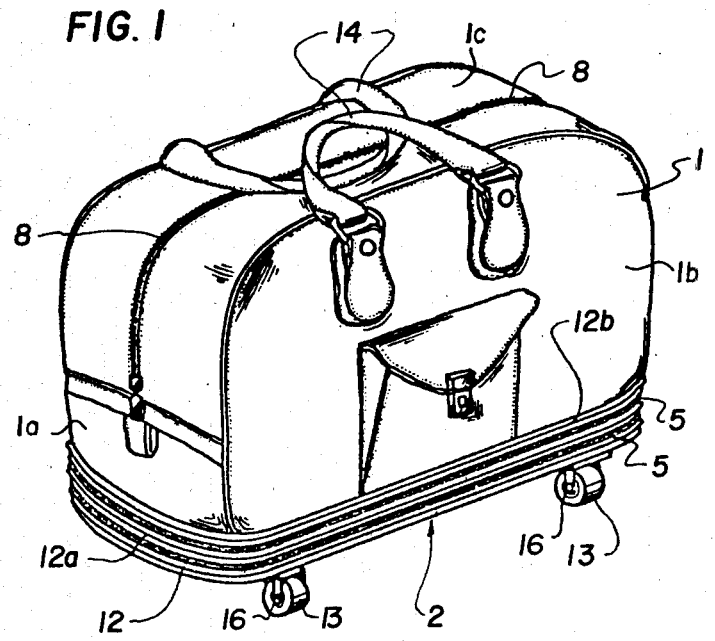
FIG. 1 is a perspective view in elevation of one preferred embodiment of gusseted suit case according to the present invention showing the gussets in the collapsed condition.

The present invention will be now described referring to the accompanying drawings which show one preferred embodiment of gusseted suit case constructed in accordance with the principle of the present invention. The suit case generally comprises a rectangular body 1 having an arched top 1*c* with opening which is adapted to be closed, by a fastener 8 attached to the opening and a closed flat bottom 2. Body 1 has end walls 1*a* and side walls 1*b*. The arched top is arched between the end walls 1*c* and extends between the side walls 1*b*. A webbing 12 is sewn to the entire periphery of the bottom edge of the body 1 and two additional similar webbings 12*a*, 12*b* are also sewn to the entire periphery of the body in a vertically spaced relationship to each other and to the first-mentioned webbing 12 at the bottom edge. The space between the topmost webbing and the intermediate webbing is substantially equal to that between the intermediate webbing and the bottom edge webbing to thereby form a first or lower gusset 9 between the bottom edge webbing 12 and the intermediate webbing 12*a* and a second or upper gusset $9_1$ between the intermediate webbing 12*a* and the topmost webbing 12*b*, respectively. Thus, the portion of the body defined by the bottom edge webbing 12 and the topmost webbing 12*b* has a bellows construction so that the body portion can be collapsed inwardly and erected.

Figure 3:
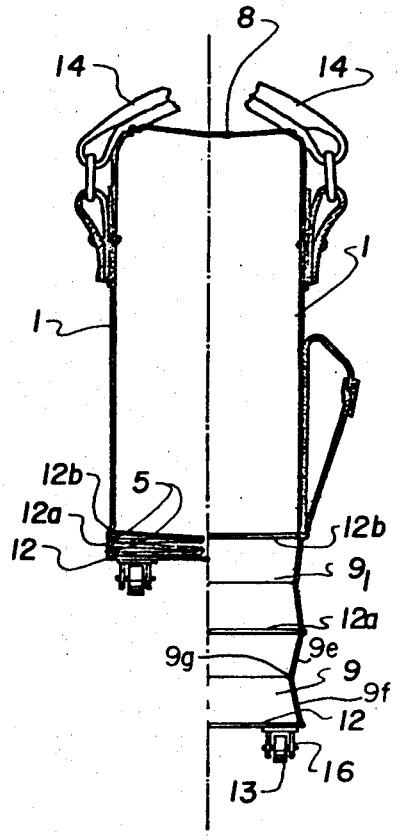
FIG. 3 is a vertically sectional view showing said suit case in a condition for use.
Figure 5:
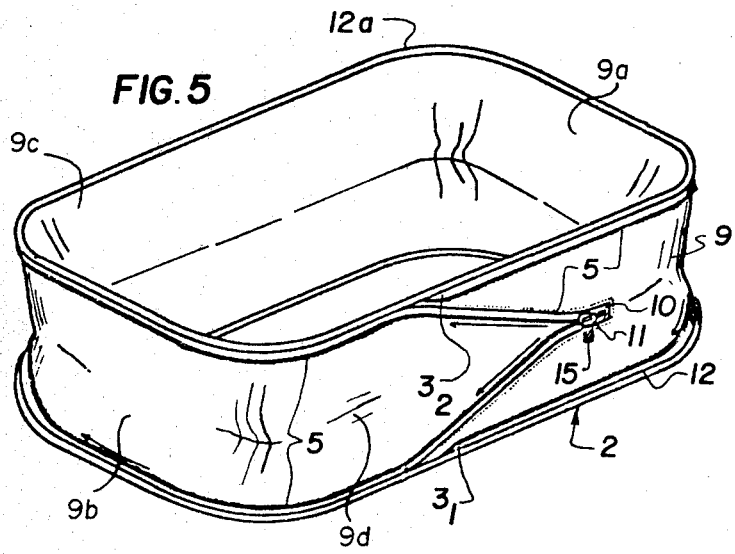
FIG. 5 is a fragmentary perspective view of one of the gussets of said suit case showing the gusset in the fully extended condition.

As shown in FIGS. 3 and 5, each gusset 9, $9_1$ extends around each web 12, 12*a*, 12*b*, and includes side walls 9*a*, 9*b* and end walls 9*c*, 9*d*. The gussets also have upper portions 9*e* and lower portions 9*f* to form a V-shaped cross-section (FIG. 3) with apex at 9*g*. The apex 9*g* is provided to move inwardly of the case so that side wall apexes move together and end wall apexes move together.

Figure 4:
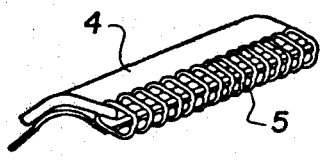
FIG. 4 is a fragmentary perspective view of the beaded fastener for said suit case.

A fastener is secured to the top and bottom edges of the gusset 9 in the conventional manner and comprises a pair of opposite fastener element assemblies 5, 5 each supported on a bead 4 (see FIG. 4), a slider 11 fitted on the opposite fastener element assemblies 5, 5, the base end 10 of the fastener element assemblies 5, 5 and a pull tab 15 secured to the slider 11. The distal ends of the fastener element assemblies 5,5 are secured to the one side of the gusset 9 at $3_1$, $3_2$, respectively.

The second or upper gusset $9_1$ is also provided with an S-shaped opening as seen in horizontal similar to the S-shaped opening as described in connection with the first or lower gusset 9 and a fastener similar to the fastener as described in connection with the first gusset 9 is attached to the opening in the gusset $9_1$ in the same manner as described in connection with the fastener for the gusset 9 with the distal ends of the second-mentioned fastener element assemblies 5, 5 secured to one side wall of the gusset $9_1$ at $3_3$, $3_4$, respectively.

In the drawings, reference numeral 13 denotes castors rotatably support on the bottom surface of the body 1 by means of bracket-shaft assemblies 16 which are secured to the bottom surface of the body 1, and reference numeral 14 denotes handles suitably attached to an upper portion of the body 1.

Figure 2:
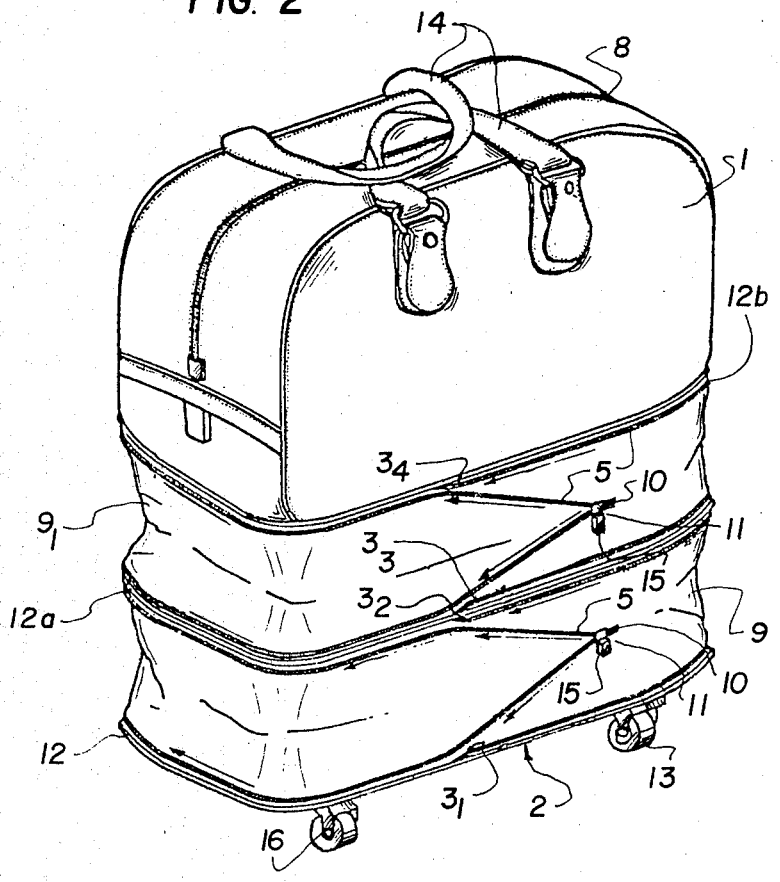
FIG. 2 is similar to FIG. 1, but shows the gussets in the fully extended condition.

With the above-mentioned construction and arrangement of the components of the gusseted suit case of the present invention, when it is desired to partially collapse the bellows portion of the body 1 from the condition as shown in FIGS. 2, 3 and 5, the pull tab 15 of the fastener associated with the lower gusset, for example, is pulled so as to cause the slider 11 to slide along the fastener element assemblies 5, 5 until the slider 11 reaches the distal or secured ends $3_1$, $3_2$ of the fastener element assemblies in the gusset whereby the lower gusset 9 is collapsed inwardly or concealed from the exterior.

And when it is desired to completely collapse the bellows portion of the body 1 of the fastener, the pull tab 15 associated with the second or upper gusset $9_1$ is also pulled to cause the slider 11 to slide along the fastener element assemblies 5, 5 until the slider reaches the distance or secured ends $3_3$, $3_4$ of the opposite fastener element assemblies in the gusset $9_1$ whereby the upper gusset $9_1$ is also collapsed inwardly or concealed from the exterior. Thus, the suite case assumes the condition as shown in FIG. 1.

As clear from the foregoing description on the preferred embodiment of the gusseted suit case according to the present invention, depending upon the size or volume of contents to be received into the suit case, the bellows portion of the body can be extended or partially or completely collapsed by manipulating the fastener or fasteners associated with one or the two gussets.

It has been known that a suit case is provided on the bottom thereof with a gusset or a bag is provided in a portion thereof with a gusset, but the known gusseted suit case or bag is provided with only one gusset and thus, the known gusseted suit case or bag cannot accommodate articles which vary in size and volume within a wide range. And according to the present invention, when the gusset 9 or $9_1$ is collapsed, the collapsed gusset is inwardly folded or concealed from the exterior except for the distal ends 3 of the fastener element assemblies, the appearance of the gusseted suit case will not be impaired. And the provision of the gusset defining webbings 12, 12*a*, 12*b* on the body 1 of the suit case reinforces the rigidity of the suit case and prevents the body 1 from bulging downwardly and/or laterally in use to thereby maintain its original configuration as the body 1 was manufactured and the suit case is conveniently carried about without difficulty. The castors 13 can be easily and simply detached from the body 1 by removing the pins from the bracket-pin assemblies.

While only one embodiment of the invention has been shown and described in detail, it will be understood that the same is for illustration purpose only and not to be taken as a definition of the invention, reference being had for this purpose to the appended claims.

What is claimed is:

1. An expandable suit case comprising:

a rectangular body (1) having end walls (1*a*), side walls (1*b*), a bottom (2) and arched top (1*c*) arched between said end walls and extending between said side walls, said arched top having an opening extending between said end walls and a fastener (8) for closing said openings;

a first web (12*b*) sewn around a lower periphery of said body end and side walls;

a first gusset ($9_1$) connected to and extending around said first web;

a second web (12*a*) sewn around a lower periphery of said first gusset;

a second gusset (9) connected to and extending around said second web;

a third web (12) sewn around a lower periphery of said second gusset, said third web also sewn around a periphery of said body bottom (2);

a first gusset fastener (5) connected to opposite upper and lower peripheries of said first gusset and adjacent said first and second webs respectively;

a second gusset fastener connected to opposite upper and lower peripheries of said second gusset and adjacent said second and third webs respectively;

each of said gussets having a V-shaped cross-section having an apex (9*g*) defined between upper (9*e*) and lower (9*f*) gusset portions, each of said first and second gussets having end walls (9*a*, 9*b*) and side walls (9*c*, 9*d*) extending downwardly of said body end walls and side walls respectively, each of said first and second gusset fasteners having a first end (10) positioned on a side wall of each of said first and second gussets respectively and adjacent said apex (9*g*), each of said first and second gusset fasteners having opposite ends ($3_1$, $3_2$) disposed on one of said webs and in the vicinity of one of said gusset side walls, said gusset fastener opposite ends extending beyond each of said gusset fastener first ends so that at least a portion of each of said first and second gusset fasteners overlap;

each of said first and second gussets having a closed position with said first and second gusset fasteners fastened and said first, second and third webs disposed adjacent each other, and an expanded position with said first and second gusset fasteners unfastened and said first, second and third webs spaced from each other;

apexes of said gusset side walls moving toward each other and apexes of said gusset end walls moving toward each other with said first and second gussets moving from said expanded position to said closed position; and a plurality of casters connected to a bottom surface of said body bottom.

2. An expandable suit case according to claim 1, wherein each of said first and second gusset fasteners and said fastener for closing said body opening comprising slide fasteners each including a pair of fastener assemblies and a slider slidable along said fastener assemblies.

* * * * *